US008327508B2

(12) United States Patent
Matsumoto

(10) Patent No.: US 8,327,508 B2
(45) Date of Patent: Dec. 11, 2012

(54) SLIDE FASTENER

(75) Inventor: Masaki Matsumoto, Mie (JP)

(73) Assignee: Masaki Matsumoto, Kuwana-shi (JP)

( * ) Notice: Subject to any disclaimer, the term of this patent is extended or adjusted under 35 U.S.C. 154(b) by 0 days.

(21) Appl. No.: 13/342,352

(22) Filed: Jan. 3, 2012

(65) Prior Publication Data

US 2012/0096686 A1 Apr. 26, 2012

Related U.S. Application Data

(63) Continuation of application No. PCT/JP2010/004280, filed on Jun. 29, 2010.

(30) Foreign Application Priority Data

Jul. 9, 2009 (JP) ..... 2009-162279

(51) Int. Cl.
*A44B 19/06* (2006.01)

(52) U.S. Cl. ..... 24/382; 24/381

(58) Field of Classification Search ..... None
See application file for complete search history.

(56) References Cited

U.S. PATENT DOCUMENTS

| | | | | |
|---|---|---|---|---|
| 2,483,057 | A | 9/1949 | Leverling | |
| 4,112,552 | A * | 9/1978 | Lee | 24/382 |
| 6,742,225 | B2 * | 6/2004 | Marty et al. | 24/382 |

FOREIGN PATENT DOCUMENTS

| | | | |
|---|---|---|---|
| JP | 53-025142 | A | 3/1978 |
| JP | 59-101104 | A | 6/1984 |
| JP | 59-111706 | A | 6/1984 |
| JP | 60-142808 | A | 7/1985 |
| JP | 2006-291371 | A | 10/2006 |
| JP | 4512164 | B1 | 7/2010 |

OTHER PUBLICATIONS

International Search Report of PCT/JP2010/004280, mailing date Oct. 12, 2010.

* cited by examiner

*Primary Examiner* — Jack W. Lavinder
(74) *Attorney, Agent, or Firm* — Westerman, Hattori, Daniels & Adrian, LLP

(57) ABSTRACT

The slide fastener comprises elements, and a slider, the slide fastener opening and closing a horizontal opening/closing portion and a vertical opening/closing portion with one operation by sliding the slider along the elements. The slide fastener includes a horizontal functional section and a vertical functional section. The horizontal functional section includes element heads which are meshed with and unmeshed from each other, and horizontal fastener tapes. The vertical functional section includes element legs extending vertically to the horizontal direction and bending into a hook-like shape, holding portions which are formed by distal ends of the element legs, and a vertical fastener tape.

4 Claims, 12 Drawing Sheets

SLIDE FASTENER

TECHNICAL FIELD

The present invention relates to creation of a fastener element having a specific shape, and to a slide fastener with a function of dividing one space into three spaces.

BACKGROUND ART

In many existing slide fasteners, elements are attached in a line to each of edges of a pair of tapes. By moving a slider between left and right elements in pair, which constitute one set of elements, the left and right elements are successively meshed with each other for closing of the slide fastener in a freely openable manner. With that structure, the slide fastener operates such that when the slider is pulled and moved from an open state of the fastener in a direction toward the side where the elements are unmeshed, the elements are meshed with each other up to the position to which the slider has been moved, and such that when the slider is pulled and moved from a closed state of the fastener in a direction toward the side where the elements are meshed, the elements are unmeshed from each other up to the position to which the slider has been moved. The slide fasteners are primarily attached to openings of clothes, bags, etc. for helping people to more easily put on and off the clothes and to take things into and out of the bags.

SUMMARY OF INVENTION

The known slide fasteners have been used just in a two-dimensional way to be adapted for the case of putting on and off the clothes and the case of opening and closing the bags, as described above. A slide fastener is provided with a function enabling the slide fastener to be used in a three-dimensional way, by creating a fastener element having a specific shape.

A slide fastener according to a first aspect comprises elements, which are arranged in a line along each of oppositely-positioned edges of opening/closing ends of horizontal fastener tapes, and a slider, the slide fastener opening and closing a horizontal opening/closing portion and a vertical opening/closing portion with one operation by sliding the slider along the elements, wherein the slide fastener includes a horizontal functional section for opening and closing the horizontal opening/closing portion and a vertical functional section for opening and closing the vertical opening/closing portion, the horizontal functional section including element heads which are meshed with and unmeshed from each other with the sliding of the slider along the elements, and horizontal fastener tapes which are opened and closed in a horizontal direction corresponding to meshing and unmeshing of the element heads, the vertical functional section including element legs which are formed by extending portions of the elements vertically to the horizontal direction and by bending the extended portions into a hook-like shape, holding portions which are formed by distal ends of the element legs coming close to and moving away from each other in conjunction with the meshing and the unmeshing of the element heads, and a vertical fastener tape which is engageable in the holding portions for selective opening/closing in the vertical direction.

In a slide fastener according to a second aspect, in addition to the features of the slide fastener according to the first aspect, the distal ends of the element legs are formed by planar surfaces such that a linear gap is formed between the distal ends when the distal ends are positioned close to each other.

In a slide fastener according to a third and fourth aspect, in addition to the features of the slide fastener according to the first aspect, the distal ends of the element legs are formed by non-planar surfaces, which are defined by projections or triangular bulged portions, such that a linear gap is not formed between the distal ends when the distal ends are positioned close to each other.

According to the slide fastener according to the first aspect, the slide fastener comprises elements, which are arranged in a line along each of oppositely-positioned edges of opening/closing ends of horizontal fastener tapes, and a slider, the slide fastener opening and closing a horizontal opening/closing portion and a vertical opening/closing portion with one operation by sliding the slider along the elements, wherein the slide fastener includes a horizontal functional section for opening and closing the horizontal opening/closing portion and a vertical functional section for opening and closing the vertical opening/closing portion, the horizontal functional section including element heads which are meshed with and unmeshed from each other with the sliding of the slider along the elements, and horizontal fastener tapes which are opened and closed in a horizontal direction corresponding to meshing and unmeshing of the element heads, the vertical functional section including element legs which are formed by extending portions of the elements vertically to the horizontal direction and by bending the extended portions into a hook-like shape, holding portions which are formed by distal ends of the element legs coming close to and moving away from each other in conjunction with the meshing and the unmeshing of the element heads, and a vertical fastener tape which is engageable in the holding portions for selective opening/closing in the vertical direction. In such a structure, the vertical fastener tape may be a single continuous tape, or may be divided into plural parts such that various materials, e.g., metal materials and resin materials, can be optionally used in a combined manner, as appropriate, to form an array of plural vertical fastener tapes. It is therefore possible to provide the slide fastener with the function enabling the slide fastener to be used in a three-dimensional way.

According to the slide fastener according to the second aspect, the distal ends of the element legs are formed by planar surfaces such that a linear gap is formed between the distal ends when the distal ends are positioned close to each other. Therefore, the vertical fastener tape can be translated in a state sandwiched between the distal ends, or the vertical fastener tape can be inserted to the linear gap between the distal ends from one end thereof while sliding it after meshing the element heads with each other.

According to the slide fastener according to the third and fourth aspects, the distal ends of the element legs are formed by non-planar surfaces, which are defined by projections or triangular bulged portions, such that a linear gap is not formed between the distal ends when the distal ends are positioned close to each other. Therefore, the vertical fastener tape can be kept, even after the use of the fastener over a long time, from being displaced in the moving direction of the slider when the slider is slid or after the element legs have been positioned close to each other with the sliding of the slider.

DETAILED DESCRIPTION OF THE INVENTION

Figure 1:
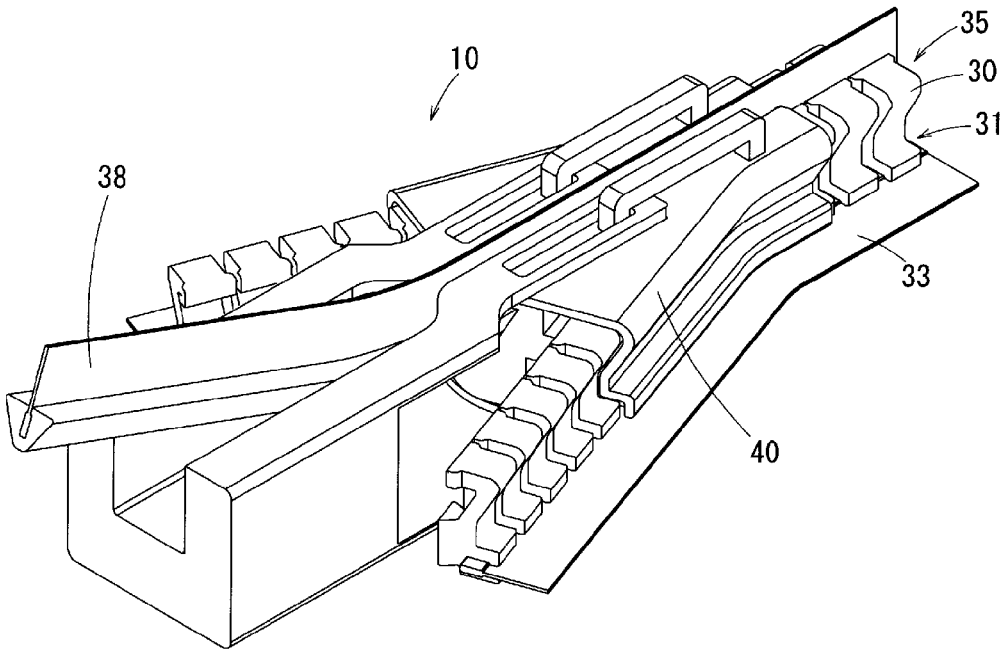
FIG. 1 is a perspective view illustrating an embodiment of a slide fastener.

An embodiment of a slide fastener according to the present invention will be described in detail below with reference to FIGS. 1 to 6. As illustrated in FIG. 1, a slide fastener 10 is constituted by elements 30, which are arranged in a line along each of oppositely-positioned edges of opening/closing ends of horizontal fastener tapes 33, and a slider 40. The slide fastener 10 includes a horizontal functional section 31 for opening and closing a horizontal opening/closing portion and a vertical functional section 35 for opening and closing a vertical opening/closing portion, both the openings/closings being performed with one operation of one slider, i.e., just by sliding one slider 40 along the elements 30 arranged on the left and right sides in pair.

Figure 2:
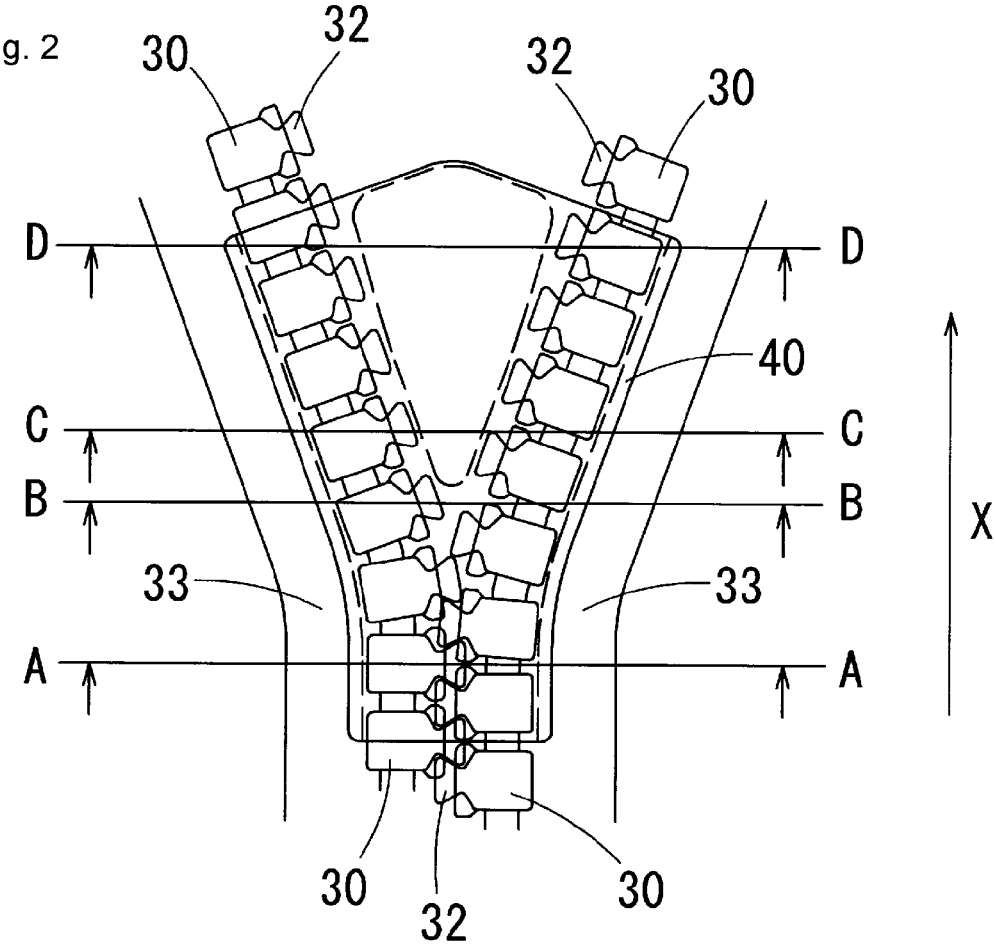
FIG. 2 is a partial rear view, looking at the rear side, of the slide fastener illustrated in FIG. 1.
Figure 3:
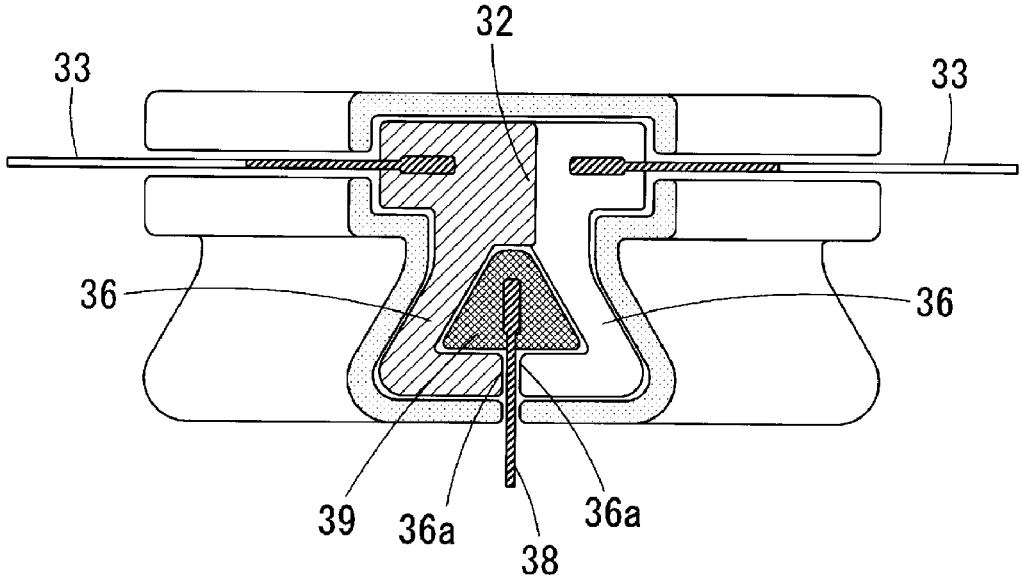
FIG. 3 is a sectional view taken along a line A-A in FIG. 2 as viewed in the direction denoted by the arrows.
Figure 4:
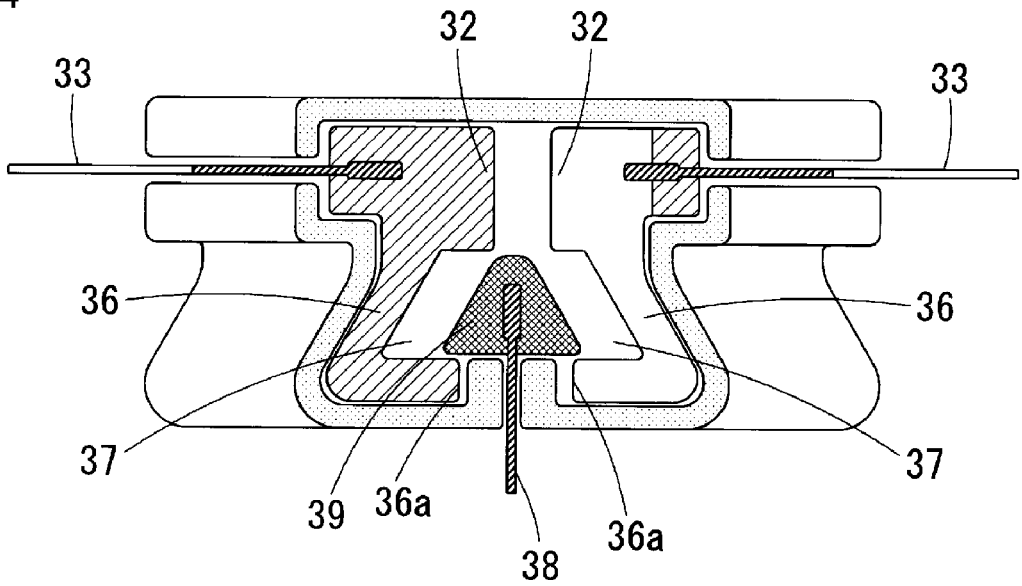
FIG. 4 is a sectional view taken along a line B-B in FIG. 2 as viewed in the direction denoted by the arrows.
Figure 5:
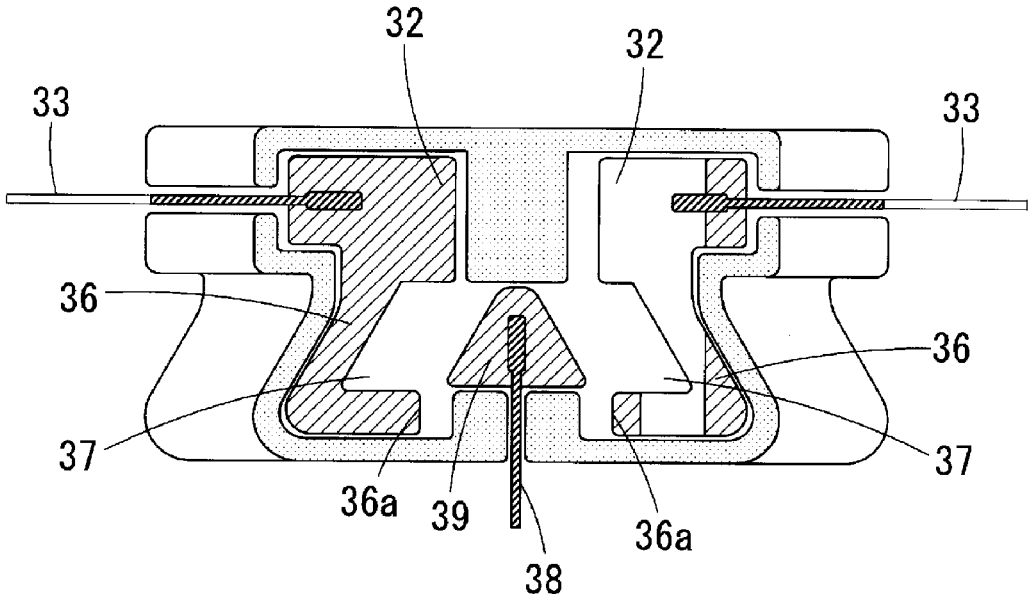
FIG. 5 is a sectional view taken along a line C-C in FIG. 2 as viewed in the direction denoted by the arrows.
Figure 6:
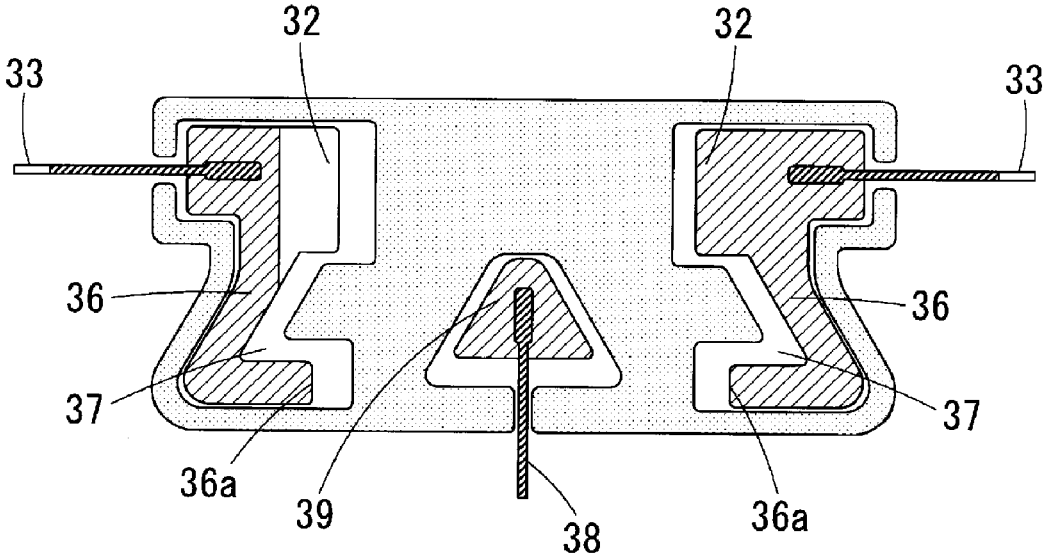
FIG. 6 is a sectional view taken along a line D-D in FIG. 2 as viewed in the direction denoted by the arrows.

As illustrated in FIG. 2, when the slider 40 is slid along the elements 30 in the direction denoted by an arrow X, the horizontal functional section 31 operates as follows. Element heads 32 are out of mesh from each other at a position (corresponding to FIG. 6) denoted by a line D-D, but they are moved to gradually come closer to each other as represented by a position (corresponding to FIG. 5) denoted by a line C-C and a position (corresponding to FIG. 4) denoted by a line B-B. Finally, the element heads 32 are meshed with each other at a position (corresponding to FIG. 3) denoted by a line A-A, whereby the horizontal fastener tapes 33 are closed in the horizontal direction.

In the vertical functional section 35, element legs 36 formed by extending portions of the elements 30 vertically to the horizontal direction are bent into a hook-like shape, and distal ends 36*a* of the hook-like bent legs 36 are positioned away from each other at the position (corresponding to FIG. 6) denoted by the line D-D. In conjunction with the operation of the element heads 32, however, the distal ends 36*a* of the element legs 36 are moved to gradually come closer to each other with the sliding of the slider 40 to the position (corresponding to FIG. 5) denoted by the line C-C and then the position (corresponding to FIG. 4) denoted by the line B-B. Finally, the distal ends 36*a* are positioned close to each other to form a holding portion 37 at the position (corresponding to FIG. 3) denoted by the line A-A. Thus, a vertical fastener-tape fixed portion 39 of the vertical fastener tape 38 is engaged in the holding portion 37, whereby the vertical fastener tape is closed in the vertical direction.

Details of the element 30 and the slider 40, both constituting the slide fastener, will be described below with reference to FIGS. 7 to 15.

Figure 7:
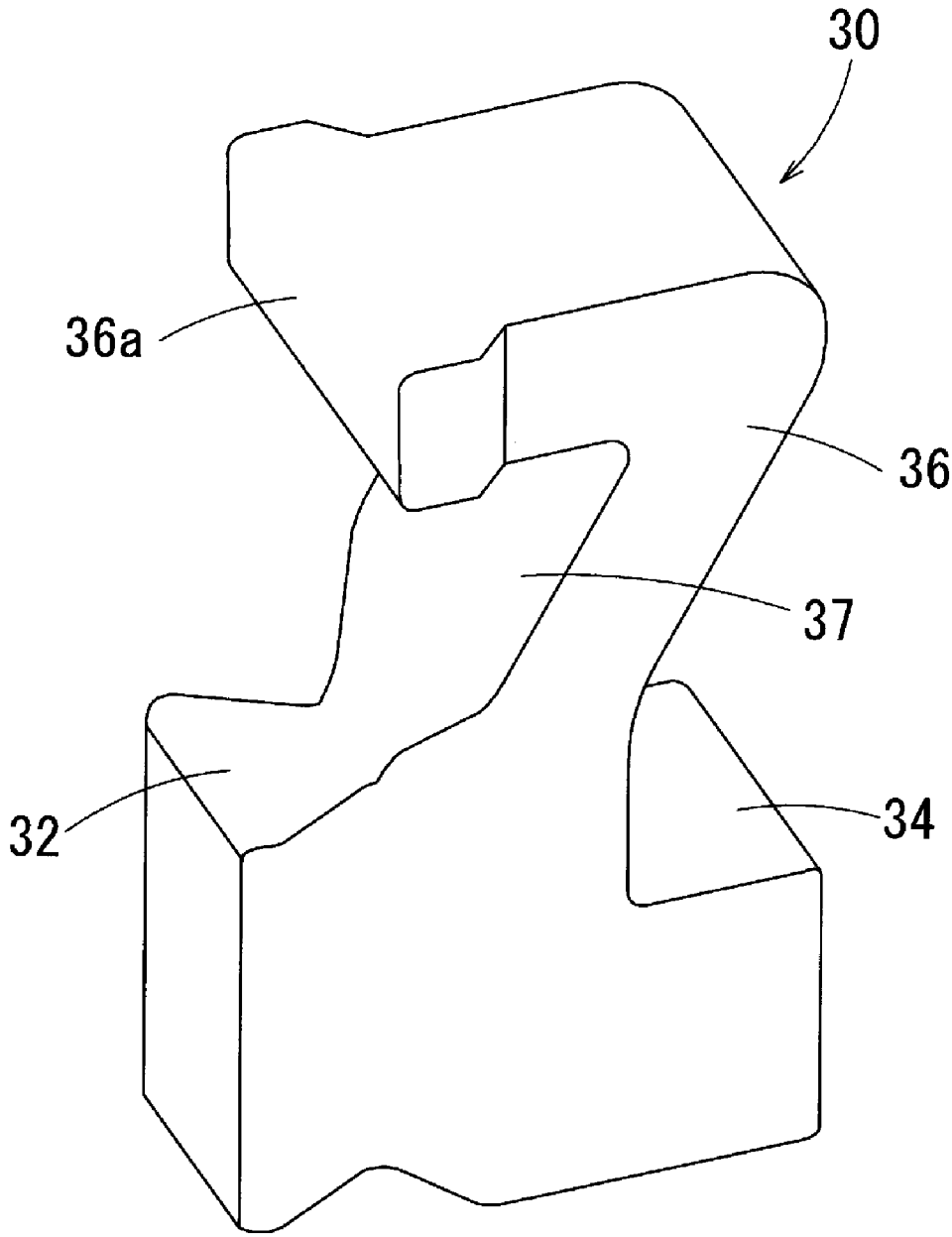
FIG. 7 is a perspective view illustrating a first embodiment of an element constituting the slide fastener.

As illustrated in FIG. 7, the element 30 has a specific shape including the element head 32 which comes into and out of mesh with the sliding of the slider, a horizontal fastener-tape fixed portion 34 fixed to one of the horizontal fastener tapes 33 which are opened and closed in the horizontal direction corresponding to meshing and unmeshing of the element heads 32, the element leg 36 which is formed by extending a portion of the element vertically to the horizontal direction and by bending the extended portion into a hook-like shape, and one half of the holding portion 37 that is formed when the distal ends 36*a* of the element legs 36 come close to and move away from each other in conjunction with the meshing and the unmeshing of the element heads 32. The vertical fastener-tape fixed portion 39 of the vertical fastener tape 38 is engageable in the holding portion 37.

Figure 8:
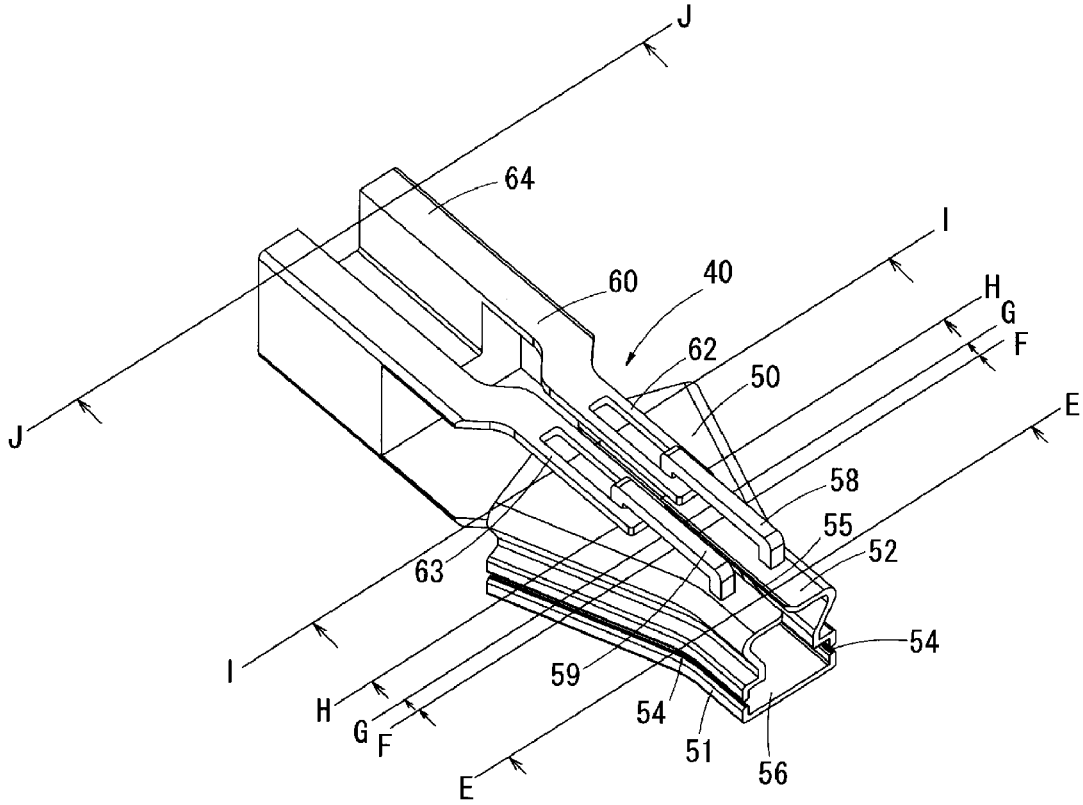
FIG. 8 is a perspective view illustrating a first embodiment of a slider constituting the slide fastener.
Figure 9:
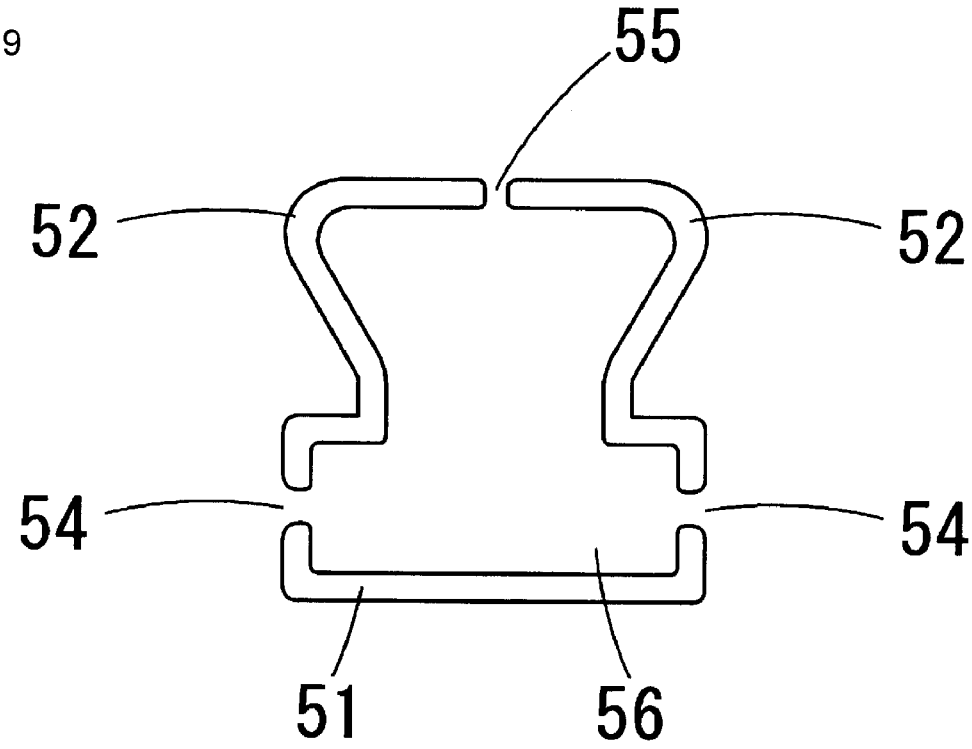
FIG. 9 is a sectional view taken along a line E-E in FIG. 8 as viewed in the direction denoted by the arrows.
Figure 13:
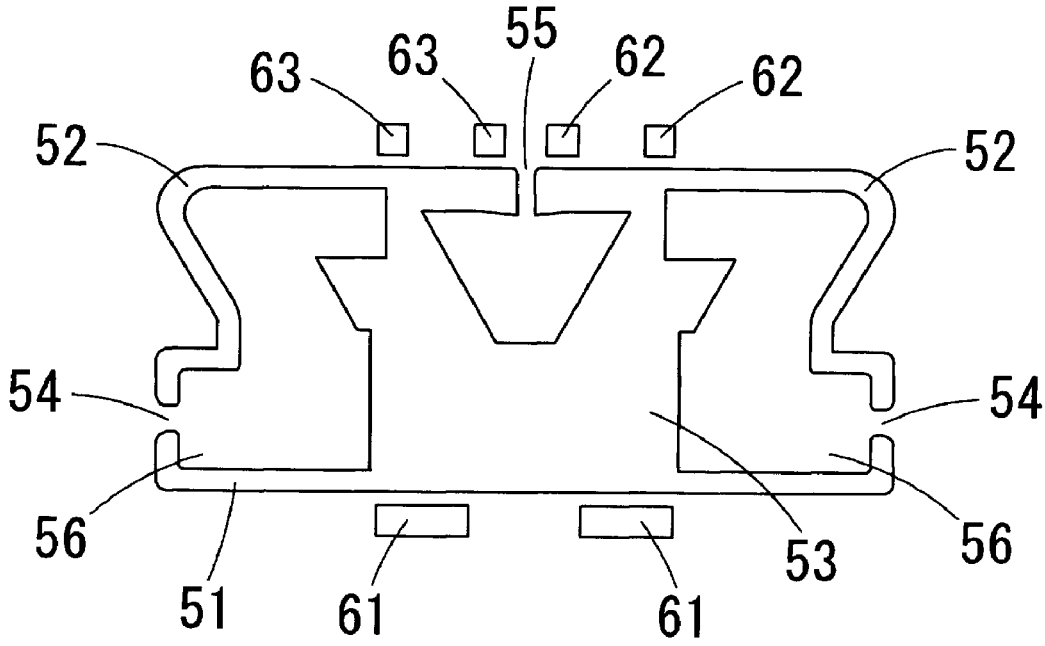
FIG. 13 is a sectional view taken along a line I-I in FIG. 8 as viewed in the direction denoted by the arrows.
Figure 14:
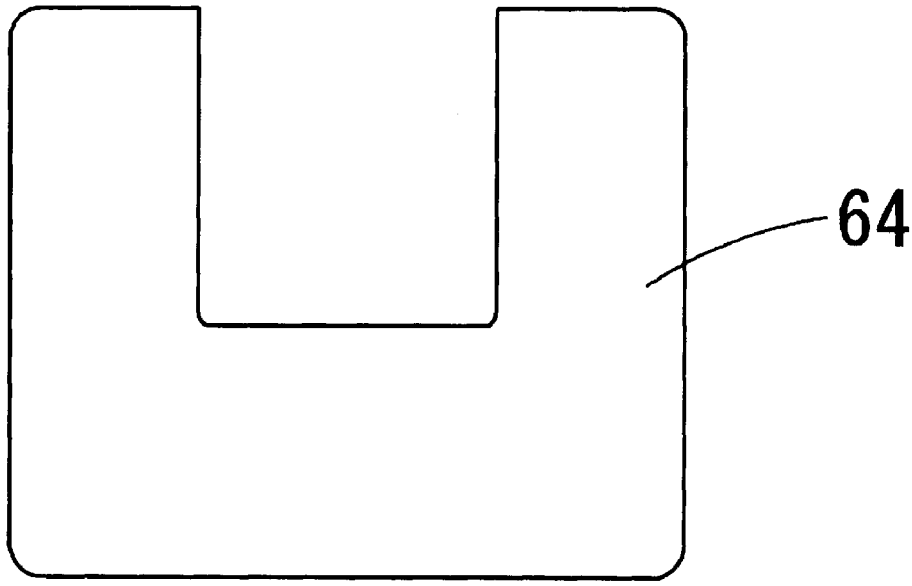
FIG. 14 is a sectional view taken along a line J-J in FIG. 8 as viewed in the direction denoted by the arrows.

As illustrated in FIG. 8, the slider 40 is constituted by a slider body 50 through which the elements 30 are moved for meshing and unmeshing, and a pull 60 used for moving the slider body 50. As illustrated in sectional views (FIGS. 9 to 14) representing respectively cross-sections of the slider body 50 taken along linear lines E to J in FIG. 8, the slider body 50 is made up of a horizontal functional-section side case 51 and a vertical functional-section side case 52 (FIG. 9), which are coupled to each other by a coupling portion 53 for coupling both the cases (FIG. 13). A horizontal slit 54 through which the horizontal fastener tape 33 is inserted is formed between the horizontal functional-section side case 51 and the vertical functional-section side case 52, and a vertical slit 55 through which the vertical fastener tape 38 is inserted is formed at the middle of the vertical functional-section side case 52.

Figure 10:
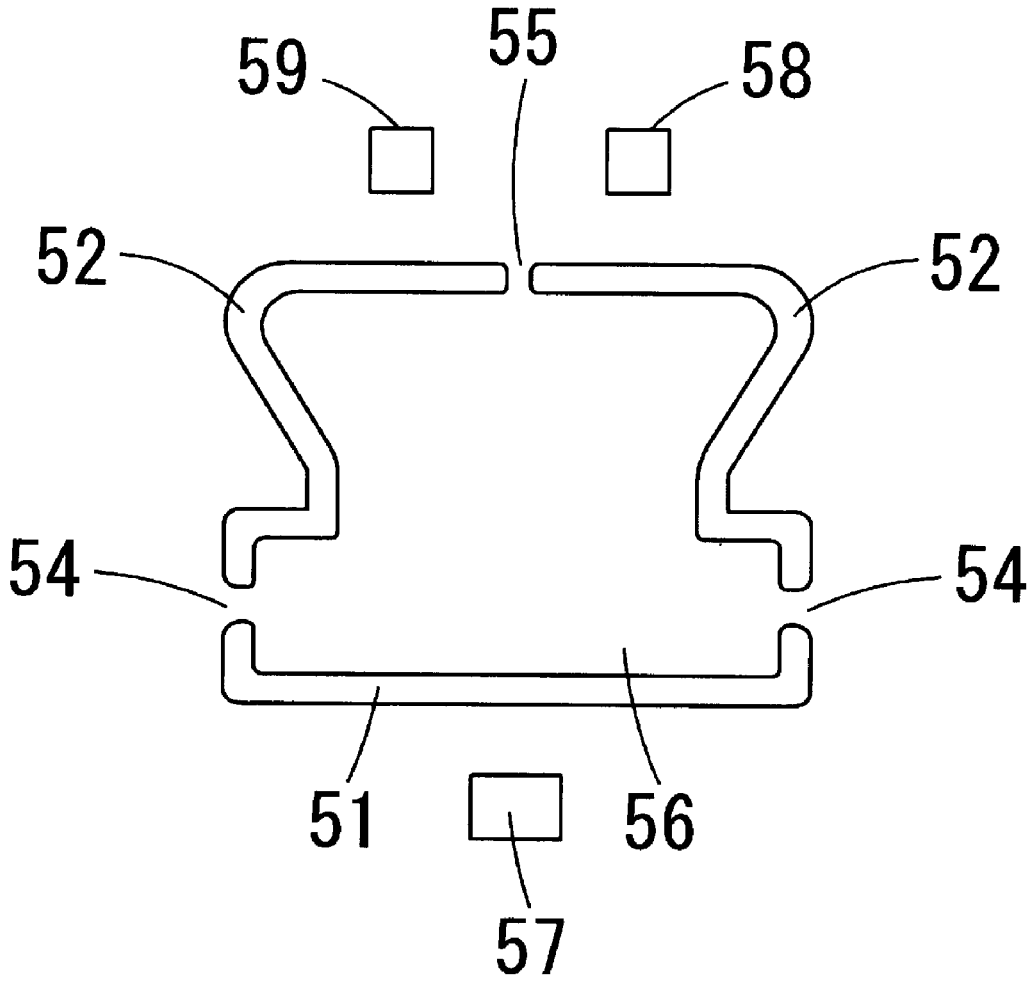
FIG. 10 is a sectional view taken along a line F-F in FIG. 8 as viewed in the direction denoted by the arrows.
Figure 11:
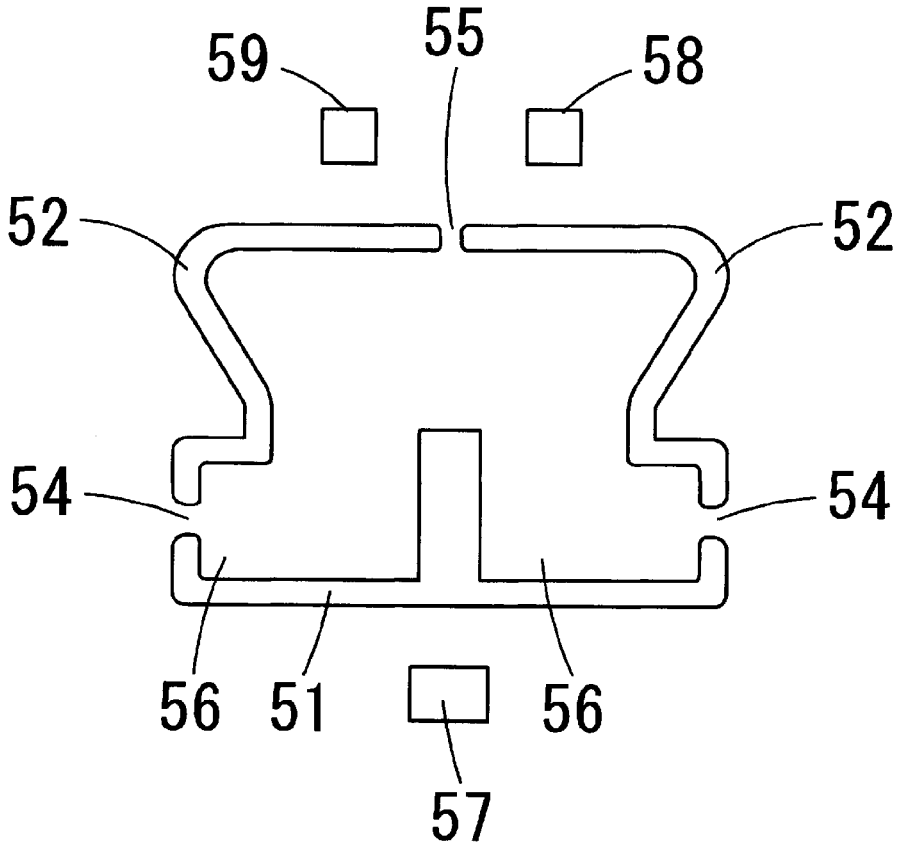
FIG. 11 is a sectional view taken along a line G-G in FIG. 8 as viewed in the direction denoted by the arrows.
Figure 12:
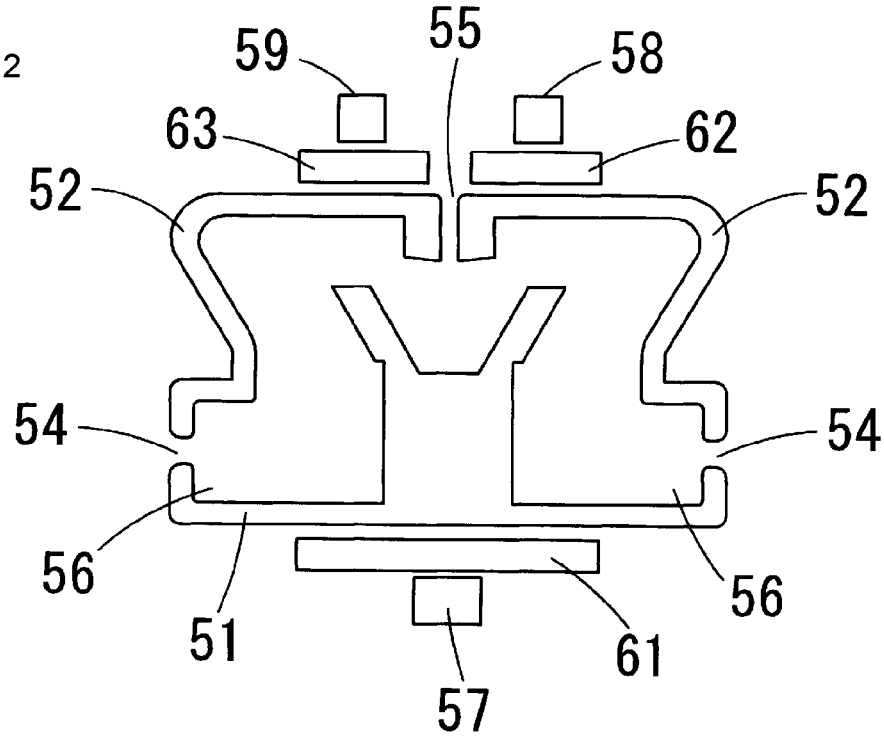
FIG. 12 is a sectional view taken along a line H-H in FIG. 8 as viewed in the direction denoted by the arrows.

An element passage 56 is formed inside the slider body 50, and the plural elements 30 arranged in a line along each of the oppositely-positioned edges of the opening/closing ends of the horizontal fastener tapes 33 are inserted through the element passage 56. The element passage 56 allows the insertion of the meshed elements 30 therethrough on the side corresponding to the linear line E (FIG. 9), and further allows the insertion of the unmeshed elements 30 therethrough, which are in the state separated to the left and the right by the coupling portion 53, on the side corresponding to the linear line I (FIG. 13). A pull attachment portion 57 is vertically provided at a center of the horizontal functional-section side case 51 (FIGS. 10, 11 and 15), and pull attachment portions 58 and 59 are vertically provided on the vertical functional-section side case 52 at both sides of the vertical slit 55 (FIGS. 8, 10 and 11).

As illustrated in FIGS. 8 and 12 to 14, the pull 60 is made up of attachment portions 61, 62 and 63 for attachment to the slider body 50, and a thumb 64. The attachment portion 61 is attached to the pull attachment portion 57 of the horizontal functional-section side case 51 of the slider body 50, and the attachment portions 62 and 63 are attached respectively to the pull attachment portions 58 and 59 of the vertical functional-section side case 52 of the slider body 50 in opposing relation on both sides of the slider body 50. In such a structure, the pull 60 is pulled to slide the slider 40 in the direction denoted by the arrow X (FIG. 2) and is pushed to slide the slider 40 in the direction reversed to that denoted by the arrow X (FIG. 2).

Figure 15:
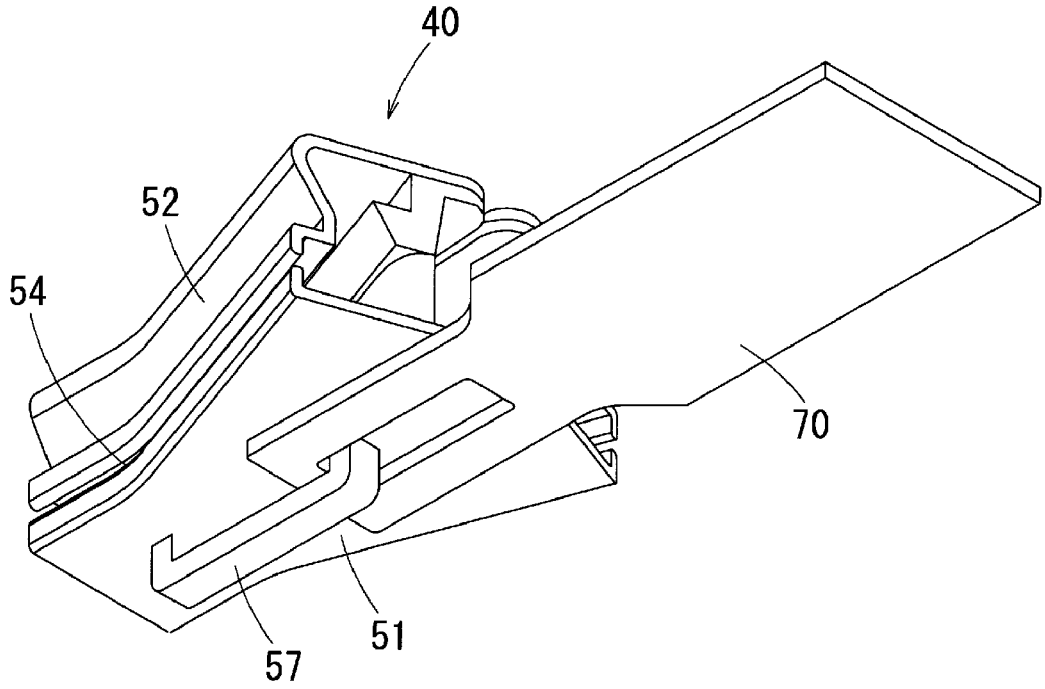
FIG. 15 is a perspective view illustrating a second embodiment of the slider constituting the slide fastener.

Although the above-described slider 40 has a shape sandwiching the pull 60 from both sides of the slider body 50, the slider may be constituted as in a second embodiment using a known flat pull 70 illustrated in FIG. 15. In that case, the pull 70 is pulled to slide the slider 40 in the direction denoted by the arrow X (FIG. 2), and it is turned through 180° and then pulled to slide the slider 40 in the direction reversed to that denoted by the arrow X (FIG. 2).

The operation of the slide fastener 10 constituted by the elements 30, each having the above-described specific shape, and the slider 40 will be described below. When the slider 40 is slid, as illustrated in FIGS. 1 and 2, along the plural elements 30 that are arranged in a line along each of the edges of the horizontal fastener tapes 33, the element heads 32 are meshed with and unmeshed from each other as illustrated in FIGS. 3 to 6 and 16, whereby the horizontal fastener tapes 33 fixed to the horizontal fastener-tape fixed portion 34 are opened and closed (FIG. 16).

Figure 16:
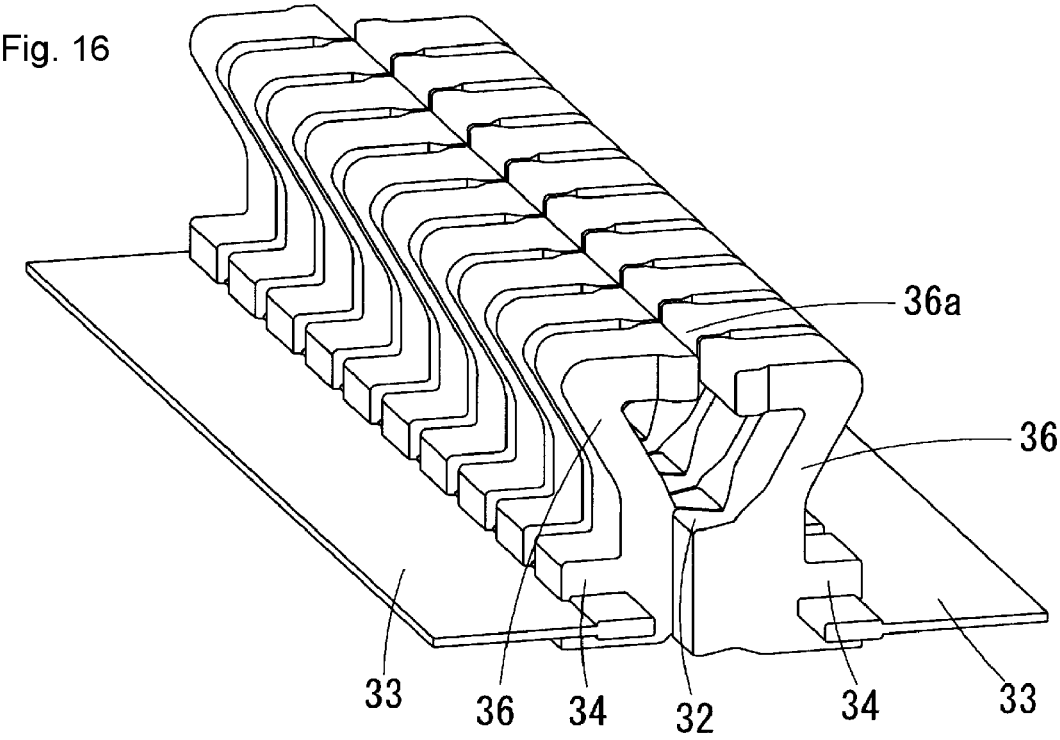
FIG. 16 is an explanatory view to explain an operation that element legs in a vertical functional section come close to each other with meshing of element heads in a horizontal functional section of the slide fastener.
Figure 17:
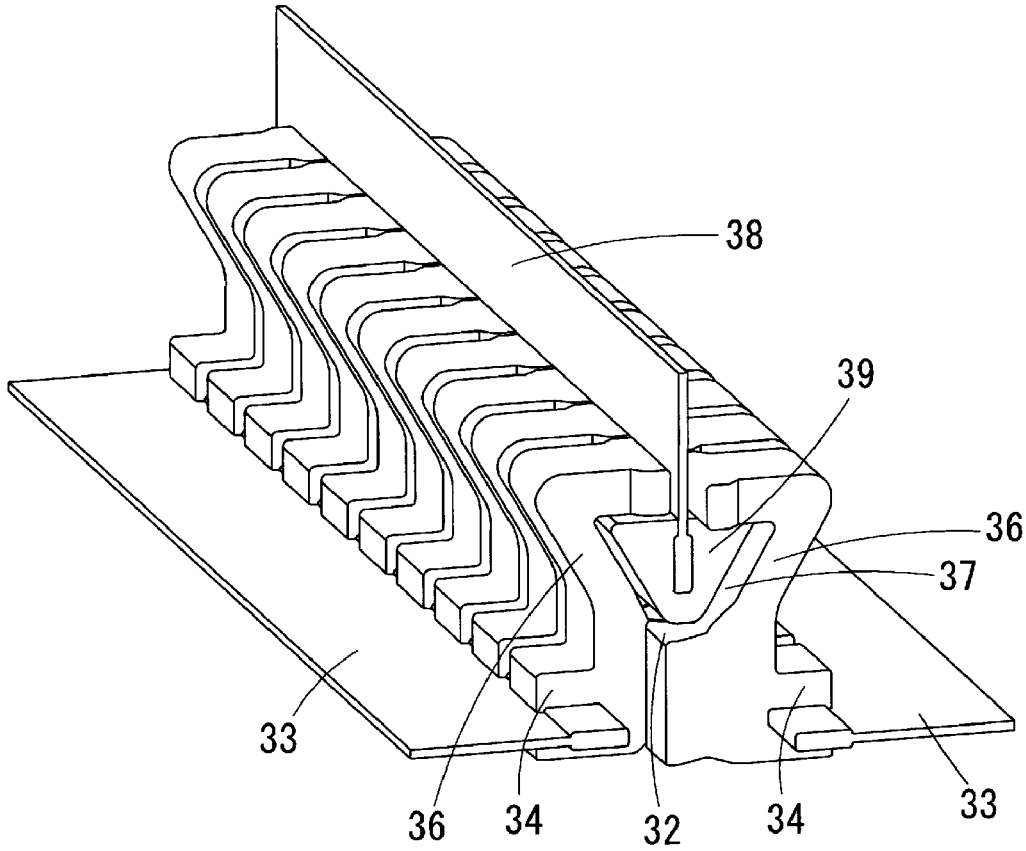
FIG. 17 is an explanatory view to explain an operation that a vertical fastener tape is engaged in holding portions, which are formed by the element legs coming close to each other, in the slide fastener.

When the heads 32 of the elements 30 are meshed with each other, the distal ends 36*a* of the element legs 36 extending vertically to the horizontal direction come closer to each other, as illustrated in FIGS. 3 to 6, 16 and 17, in conjunction with the meshing of the element heads 32 (FIG. 16). Because the element legs 36 are bent into the hook-like shape, the holding portion 37 is formed by the distal ends 36*a* of the element legs 36, which are positioned close to each other. When the holding portions 37 are formed by the distal ends 36*a* of the element legs 36 positioned close to each other, the vertical fastener-tape fixed portion 39 to which the vertical fastener tape 38 is fixed is engaged in the holding portions 37 (FIG. 17).

Figure 18:
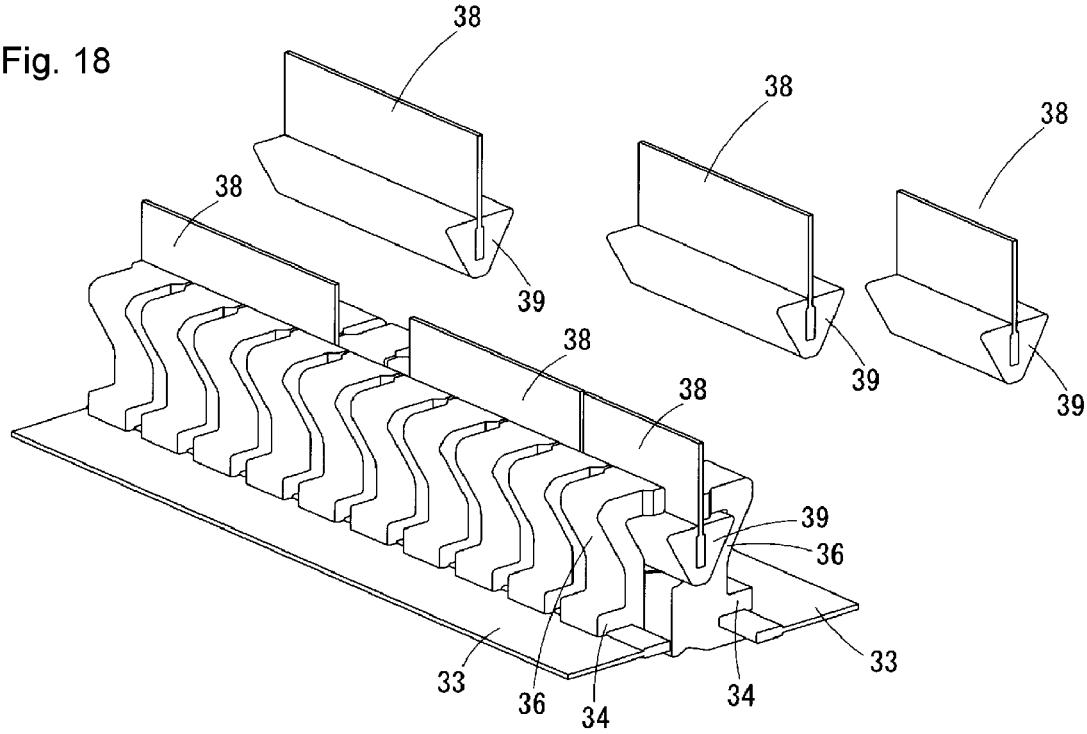
FIG. 18 is an explanatory view to explain another operation that the vertical fastener tape is engaged in the holding portions, which are formed by the element legs coming close to each other, in the slide fastener.

FIG. 17 illustrates a basic form in which the vertical fastener tape 38 engaged in the holding portion 37 is a single continuous tape, but the vertical fastener tape 38 may be divided into plural parts as illustrated in FIG. 18. By dividing the vertical fastener tape 38 into plural parts, various materials, such as metal materials and resin materials, can be optionally used in a combined manner, as appropriate, to form an array of plural vertical fastener tapes.

In the embodiment described above, since the distal ends 36*a* of the element legs 36 are formed by planar surfaces, a linear gap is formed between the distal ends 36*a* when the distal ends 36*a* are positioned close to each other. Accordingly, the vertical fastener tape 38 can be translated in a state sandwiched between the distal ends 36*a*, or the vertical fastener tape 38 can be inserted to the linear gap between the distal ends 36*a* from one end thereof while sliding it after meshing the element heads 32 with each other.

Figure 19:
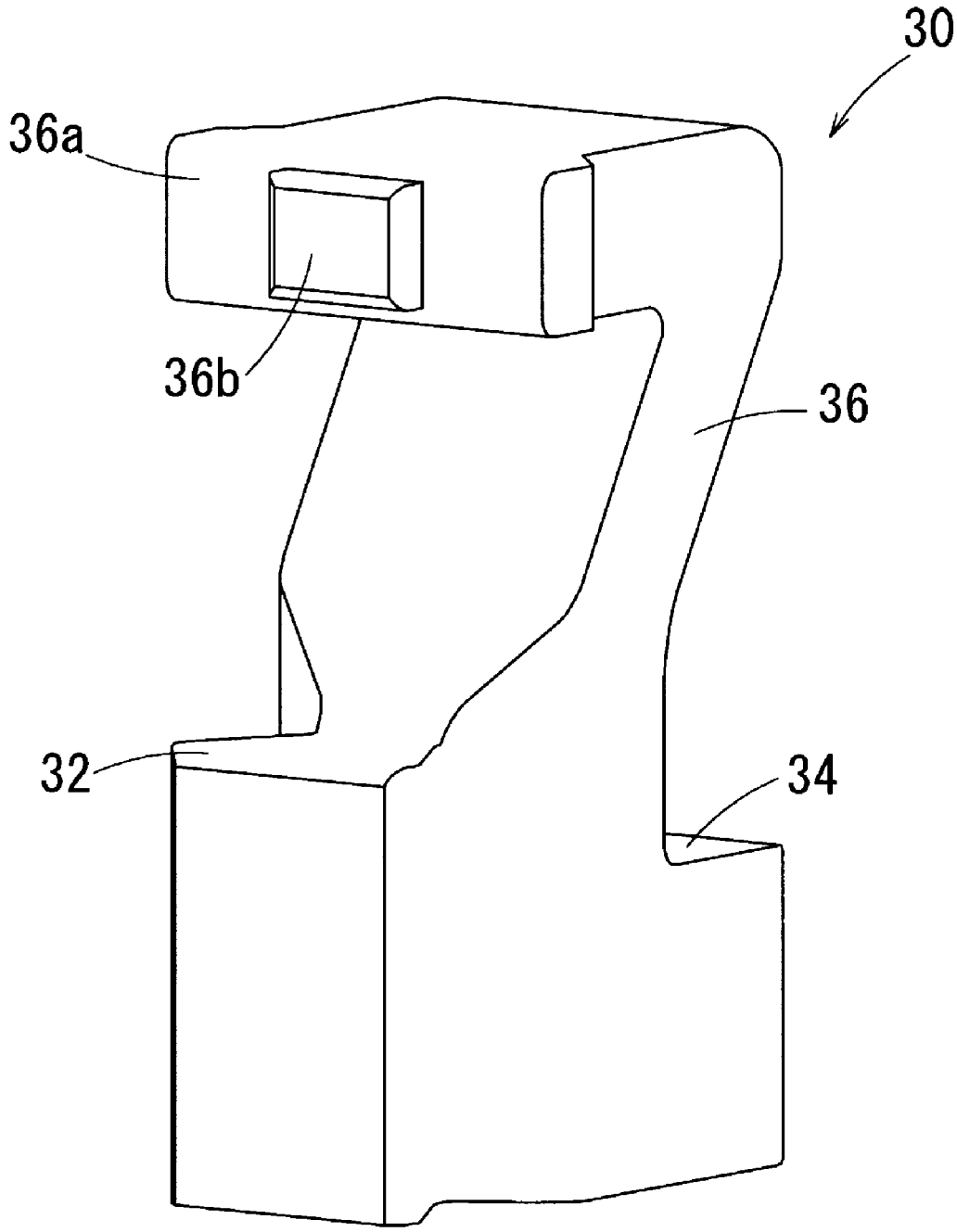
FIG. 19 is a perspective view illustrating a second embodiment of the element constituting the slide fastener.

In contrast, the distal ends 36*a* of the element legs 36 may be formed by non-planar surfaces such that the vertical fastener tape 38 will not be displaced in the moving direction of the slider even when the fastener is used over a long time. FIG. 19 illustrates a second embodiment of the element 30 in which a projection 36*b* is provided on the distal end 36*a* of the element leg 36 bent into the hook-like shape such that the linear gap is not formed between the distal ends 36*a*.

Figure 20:
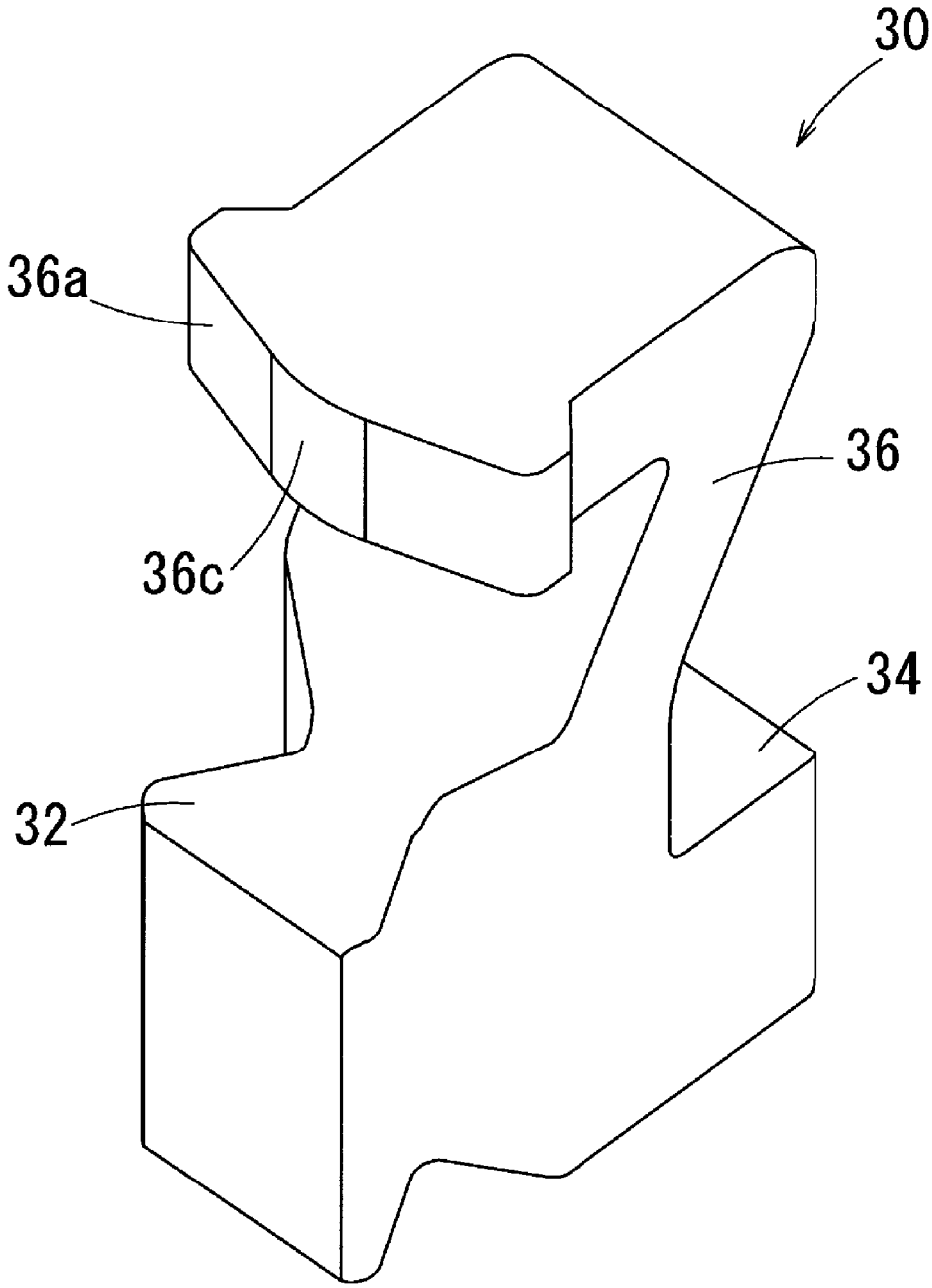
FIG. 20 is a perspective view illustrating a third embodiment of the element constituting the slide fastener.

Further, FIG. 20 illustrates a third embodiment of the element 30 in which a triangular bulged portion 36*c* is provided on the distal end 36*a* of the element leg 36 bent into the hook-like shape such that the linear gap is not formed between the distal ends 36*a* as in the second embodiment. By forming the distal end 36*a* of the element leg 36 to have a non-planar surface, e.g., in the form of the projection 36*b* or the triangular bulged portion 36*c*, as described above, the vertical fastener tape 38 can be kept, even after the use of the fastener over a long time, from being displaced in the moving direction of the slider when the slider is slid or after the element legs have been positioned close to each other with the sliding of the slider.

As described above, the slide fastener includes the horizontal functional section for opening and closing the horizontal opening/closing portion and the vertical functional section for opening and closing the vertical opening/closing portion. The horizontal functional section includes the element heads which are meshed with and unmeshed from each other with the sliding of the slider along the elements, and the horizontal fastener tapes which are opened and closed in the horizontal direction corresponding to the meshing and the enmeshing of the element heads. The vertical functional section includes the element legs which are formed by extending portions of the elements vertically to the horizontal direction and by bending the extended portions into the hook-like shape, the holding portions which are formed by the distal ends of the element legs coming close to and moving away from each other in conjunction with the meshing and the unmeshing of the element heads, and the vertical fastener tape which is engageable in the holding portions for selective opening/closing in the vertical direction. In such a structure, the vertical fastener tape may be a single continuous tape, or may be divided into plural parts such that various materials, e.g., metal materials and resin materials, can be optionally used in a combined manner, as appropriate, to form an array of plural vertical fastener tapes. It is therefore possible to provide the slide fastener with the function enabling the slide fastener to be used in a three-dimensional way.

Further, when the slide fastener is applied to partitioning of the inside of a temporarily installed tent with the horizontal functional section and the vertical functional section both oriented to extend in the up-and-down direction, one living space formed inside the temporarily installed tent can be divided into three independent spaces with one operation using one slider.

The invention claimed is:

1. A slide fastener comprising:

two horizontal fastener tapes, elements which are arranged in a line along each of oppositely-positioned edges of opening/closing ends of the two horizontal fastener tapes, each of the elements including a section having an element head on one horizontal side of the section and a fastener-tape fixed portion on the other horizontal side of the section, the fastener-tape fixed portion being attached to one of the two horizontal fastener tapes, and an element leg extending from the element head in the vertical direction and being bent into a hook shape, a slider in which the elements attached to a first one of the two horizontal fastener tapes and a second one of the two horizontal fastener tapes are arranged to oppositely face each other and in which the element heads of the elements are meshed with each other by sliding the slider between oppositely-positioned elements, whereby distal ends of the element legs of the oppositely-positioned elements form a holding portion, and a vertical fastener tape having a vertical fastener tape fixed portion ached thereto, wherein the vertical fastener-tape fixed portion of the vertical fastener tape is engageable in the holding portion.

2. The slide fastener according to claim 1, wherein the distal ends of the element legs have planar surfaces such that a linear gap is formed between the distal ends when the holding portion is formed.

3. The slide fastener according to claim 1, wherein the distal ends of the element legs have non-planar surfaces and include projections, such that a linear gap is not formed between the distal ends when the holding portion is formed.

4. The slide fastener according to claim 1, wherein the distal ends of the element legs have non-planar surfaces and include triangular bulged portions, such that a linear gap is not formed between the distal ends when the holding portion is formed.

* * * * *